United States Patent [19]

Oda et al.

[11] Patent Number: 4,833,883

[45] Date of Patent: May 30, 1989

[54] FILTER UNIT, AND APPARATUS FOR TREATING PARTICULATES IN AN EXHAUST GAS FROM A DIESEL ENGINE

[75] Inventors: Noriyuki Oda, Chiba; Tetsuo Takehara, Kawasaki; Satoshi Enamito, Yokohama, all of Japan

[73] Assignee: Asahi Glass Company Ltd., Tokyo, Japan

[21] Appl. No.: 99,600

[22] Filed: Sep. 22, 1987

[51] Int. Cl.[4] ..... F01N 3/02

[52] U.S. Cl. ..... 60/311; 60/279; 60/303; 55/302; 55/466; 55/523; 55/DIG. 30

[58] Field of Search ..... 60/274, 286, 279, 311, 60/303; 55/302, 466, 523, DIG. 30

[56] References Cited

U.S. PATENT DOCUMENTS

| | | | |
|---|---|---|---|
| 4,290,263 | 9/1981 | Mann | 60/311 |
| 4,406,119 | 9/1983 | Kamiya | 60/311 |
| 4,433,986 | 2/1984 | Borst | 55/302 |
| 4,478,618 | 10/1984 | Bly . | |
| 4,584,003 | 4/1986 | Oda . | |

FOREIGN PATENT DOCUMENTS

| | | | |
|---|---|---|---|
| 0121445 | 10/1984 | European Pat. Off. . | |
| 213725 | 3/1987 | European Pat. Off. | 60/279 |
| 0220588 | 5/1987 | European Pat. Off. . | |
| 56-98518 | 8/1981 | Japan . | |
| 56-124417 | 9/1981 | Japan . | |
| 2064360 | 6/1981 | United Kingdom . | |

*Primary Examiner*—Douglas Hart

*Attorney, Agent, or Firm*—Oblon, Fisher, Spivak, McClelland & Maier

[57] ABSTRACT

A filter unit comprises a plurality of plates made of an air-permeable, porous material which define particulate-containing gas passages and clean gas passages. The clean gas passages are formed at one side of each of the air-permeable, porous plates and the particulate-containing gas passages are at the other side in the direction intersecting each other. Particulates in an exhaust gas from a diesel engine deposit and accumulate on the air-permeable, porous plate while the exhaust gas is passed from the particulate-containing gas passages through the air-permeable, porous plates to the clean gas passages. A nozzle is placed in an outlet conduit, which is connected to the discharging side of the clean gas passages, to eject gas for back washing to thereby peel off and drop the particulates on the air-permeable, porous plates. A particulate receiving plate is provided to collect the particulates, which are burnt by a heater provided in the particulate receiving plate.

49 Claims, 7 Drawing Sheets

FILTER UNIT, AND APPARATUS FOR TREATING PARTICULATES IN AN EXHAUST GAS FROM A DIESEL ENGINE

The present invention relates to an apparatus for trapping or removing particulates containing carbon as a main component in an exhaust gas from a diesel engine and a filter unit suitably used for such apparatus, the diesel engine being particularly used for various vehicles such as passenger cars, trucks, buses, railway cars and so on, and industrial machines, ships.

An exhaust gas discharged from a diesel engine contains a fairly large quantity of particulates including carbon particles as a main component which causes air pollution.

Various apparatuses for trapping or removing such particulates in the exhaust gas from the diesel engines by using a filter unit are proposed.

Japanese Unexamined Patent Publication 124417/1981 discloses a filter unit 90 having the construction as shown in FIG. 1. The filter unit 90 is of a column-like body as a basic construction in which there are a plurality of thin, air-permeable, porous ceramic walls 91 to define a great number of parallel gas passages 92 which are adjacent to each other with respect to the thin walls which are present as boundaries between the adjacent gas passages, the column-like body constituting a ceramic monolithic honeycomb body. As indicated by slant hatched lines in FIG. 1, the gas passages are alternately closed in a form of a check pattern at one end face of the column-like body. Namely, there are two groups of gas passages in which one group of the gas passages have opened end part at a first face of the column-like body and closed end part at the second face opposing the first face, and the other group have opened end part at the second face and closed end part at the first face.

When the exhaust gas from the diesel engine is fed through the one end face of the filter unit 90, particulates in the exhaust gas are trapped by the inner surfaces of the thin walls 91 which function as filtering surfaces, and a clean exhaust gas obtained by removing the particulates is discharged from the other end face. The particulates which consist mainly of carbon particulates are burned at a suitable time of interval by heating the thin walls 91; thus the filter unit 90 is refreshed.

The Japanese Publication (Japanese Unexamined Patent Publication 124417/1981) also discloses a filter unit 10 made of ceramics as shown in FIG. 2. The filter unit 10 has an outer configuration of a rectangular solid form as a whole, and is constituted by a plurality of rectangular plate-like bodies 11, 12 (eight plate-like bodies in FIG. 2) which are arranged in parallel to each other, ribs 13, 15 and spacers 14, 16. The plate-like bodies 11, 12, the ribs 13, 15 and the spacers 14, 16 are formed by an air-permeable, porous solid bodies made of ceramics having filtering function. The plate-like bodies 11 constitute the upper and lower faces of the filter unit 10 and the plate-like bodies 12 constitute intermediate surfaces. The end ribs 13 and the spacers 14 as intermediate elements are positioned between the adjacent plate-like bodies 11, 12 or 12, 12 so as to be in parallel to a side edge of the plate-like bodies 11. The upper edge of the ribs 13 and the spacers 14 are in one-piece contact with the plate-like bodies 11 or 12 placed above these elements 13, 14, and the lower edge of the ribs 13 and the spacers 14 are in one-piece contact with the plate-like bodies 12 or 11 placed below these elements 13, 14, whereby a plurality of particulate-containing gas passages 17 with both ends opened are formed. The ribs 13 and the spacers 14 are provided on one side surface of the plate-like bodies 12 and the ribs 15 and the spacers 16 are provided on the other side surface of the same plate-like bodies 12 so as to extend in the direction perpendicular to the ribs 13 and the spacers 14. The ribs 15 and the spacers 16 are substantially the same as the ribs 13 and the spacers 14 except the direction of extension. Thus, the particulate-containing gas passages 17 with the both end opened and clean gas passages 18 extending in the direction perpendicular to the particulate-containing gas passages 17 are provided.

A particulate removing apparatus using such filter unit 10 is disclosed in Japanese Patent Publication No. 98518/1981 in which the particulate-containing gas passages 17 have two open end parts; one of the open end part is directly or indirectly closed, and an exhaust gas from a diesel engine is introduced through the other end part, or the both ends of the particulate-containing gas passages 17 are opened and the exhaust gas is simultaneously introduced through the both end parts. In this case, the plate-like bodies 12 function as filtering surfaces, and particulates are trapped on the surfaces of the plate-like bodies 12 at the side of the particulate-containing gas passages 17, whereby a clean exhaust gas obtained by removing the particulates is discharged through the plate-like bodies 12 to the outside of the system via the clean gas passages 18. The plate-like bodies 12 are heated at a suitable time of interval to burn the trapped particulates. Thus, the filter unit 10 is refreshed.

In the prior art techniques as described above, the particulates are burnt off by heating the thin walls 91 or the plate-like bodies 12 having filtering function up to an ignition temperature. As a material used for the filter unit, it was necessary to use ceramics so as to be durable to such burning temperature (600° C.-1,000° C.). Generally, the size of the particulates in the exhaust gas from the diesel engine are extremely fine. Accordingly, in order to trap the particulates with a high trapping efficiency and a small pressure loss, a complicated ceramic filter unit is required. It is often difficult to satisfy the above-mentioned requirements at the same time.

The filter unit was further sintered by repeated application of heating up to a burning temperature of the trapped particulates. Then, pore size and pore distribution in the original filter unit were rapidly changed, whereby the trapping efficiency and pressure loss changed with a lapse of time, and therefore, a stable particulate trapping properties could not be maintained. Deterioration in various properties is caused mainly by deterioration with age of the filter unit. Particularly, some parts of the thin walls 91 or the plate-like bodies 12 often melted by the burning operation to remove the particulates at a high temperature, and the particulates, consequently, could not be trapped.

The exhaust gas from the diesel engine contains not only carbon particulates but also an unnegligible amount of non-combustible particles (for instance, 1%-5% by weight to the total amount of the particulates), and these non-combustible components are also trapped by the filter unit 10. Furthermore, a corrosive component such as SOx or NOx in the exhaust gas reacts with materials constituting conduit elements for the exhaust gas and the filter unit to produce non-combustible solid components which deposit on the filter unit. These non-combustible solid components can not be removed by burning and then deteriorate the properties of the filter unit.

U.S. Pat. No. 4,584,003 discloses a dust removing apparatus for a hot gas containing dust. The dust removing apparatus comprises a plurality of vertical filter tubes having both ends opened. The hot gas containing dust is introduced from the upper portion of the filter tubes. The dusts are hindered by the filter tube walls from passing therethrough and are collected in a dust hopper provided below the filter tubes, while a clean gas obtained by passing through the filter tube walls is discharged through the side surface of the filter tubes. It is understood that the dust removing apparatus of this patent is suitable for treating a large flow rate of gas containing much amount of non-combustible dusts produced from an apparatus such as a converter in an iron plant. However, the patent does not suggest application of the apparatus to the treatment of an exhaust gas from a diesel engine. The patent also does not suggest provision of the filter unit 10 having a compact form as shown in FIG. 2.

It is an object of the present invention to eliminate the above-mentioned disadvantages of the conventional apparatus and to provide an apparatus or a method for trapping or removing particulates in an exhaust gas from a diesel engine in which a filter unit allowing a wide range of selection of material is used.

It is another object of the present invention to provide an apparatus or a method for trapping or removing the particulates on the filter unit without heating the filter unit at a high temperature.

It is still another object of the present invention to provide an apparatus or a method for trapping or removing non-combustible particles as well as combustible particulates.

It is still another object of the present invention to provide an apparatus or a method for trapping or removing particulates, which assures filtering properties in a stable manner for a long time.

It is still another object of the present invention to provide an apparatus or a method for trapping or removing particulates in which the apparatus can be compact and a space for installation of it can be small.

According to the present invention, there is provided an apparatus for treating particulates in an exhaust gas from a diesel engine which comprises a filter unit provided with partition walls made of an air-permeable, porous solid material which define a plurality of particulate-containing gas passages having opened ends and at least one clean gas passage separated from the particulate-containing gas passages by the partition walls, an inlet duct for distributing and feeding the exhaust gas from the diesel engine to one side of the opened ends of the particulate-containing gas passages, a particulate receiving port which surrounds or closes the other side of the opened ends of the particulate-containing gas passages, an outlet conduit for the exhaust gas which flows from the particulate-containing gas passages through the partition walls to the clean gas passage, a back washing means for generating intermittently a flow of gas which flows from the clean gas passage through the partition walls to the particulate-containing gas passages, and a burning means for burning and removing combustible particulates collected in the particulate receiving port.

Further, according to the present invention, there is provided an apparatus for treating particulates in an exhaust gas from a diesel engine which comprises a filter unit having a plurality of plate-like bodies made of an air-permeable, porous material and having the same shape, which are arranged in parallel to and separated from each other, and ribs provided between each adjacent pairs of the plate-like bodies at their edge portions so as to form particulate-containing gas passages or clean gas passages, wherein on one side of each of the plate-like bodies which are adjacent to each other, there are no ribs at positions facing an inlet duct and a particulate receiving port, while on the other side of each of the plate-like bodies, there are no ribs at the position facing an outlet conduit, whereby a plurality of the particulate-containing gas passages having opened ends and a plurality of the clean gas passages are formed by the plate-like bodies which function as a boundary, the inlet duct distributing and feeding the exhaust gas from the diesel engine to one side of the opened ends of the particulate-containing gas passages, the particulate receiving port surrounding or closing the other side of the opened ends of the particulate-containing gas passages, the outlet conduit for the exhaust gas which flows from the particulate-containing gas passages through the plate-like bodies to the clean gas passages, and a back washing means for generating intermittently a flow of gas which flows from the clean gas passages through the plate-like bodies to the particulate-containing gas passages.

Further, according to the present invention, there is provided a filter unit having a shape of prism with a bottom face having a shape selected from the group of a triangle, a parallelogram with non-right-angled corners and a trapezoid with parallel sides of different length, the filter unit comprising a plurality of plate-like bodies which are made of an air-permeable, porous material and having the same shape as that of the bottom face, and which are arranged in parallel to and spaced apart from each other, and ribs provided between each adjacent pairs of the plate-like bodies at their edge portions so as to form particulate-containing gas passages or clean gas passages, wherein on one side of each of the plate-like bodies which are adjacent to each other, there are no ribs at the positions corresponding to a pair of opposing side faces of the prism shape, while on the other side of each of the plate-like bodies, there are no ribs at the position corresponding to at least one side face which is different from the pair of opposing side faces, whereby a plurality of the particulate-containing gas passages having ends opened at the opposing side faces and a plurality of the clean gas passages having an end opened at at least one side face which is different from the opposing side faces are formed so as to isolate them from the particulate-containing gas passages by the plate-like bodies.

Figure 1:
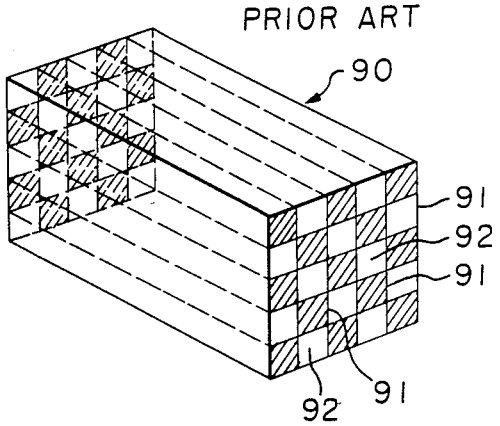
FIGURE 1 PRIOR ART
FIG. 1 is a diagram showing a conventional filter unit.
Figure 2:
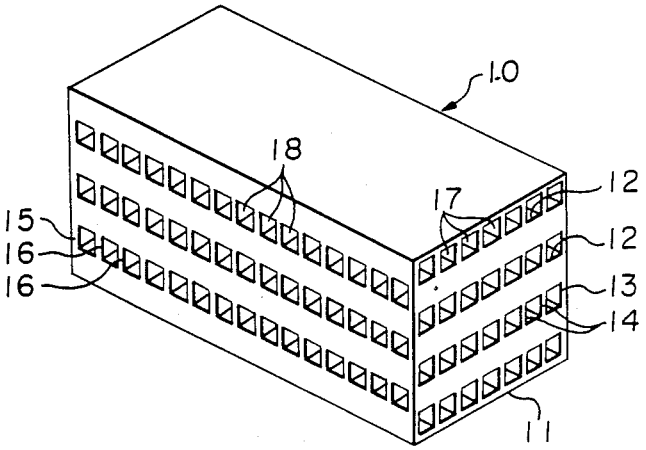
FIGURE 2 PRIOR ART
FIG. 2 is a perspective view of another conventional filter unit.

Preferred embodiments of the present invention will be described with reference to the accompanying drawings. However, the present invention should not be limited to only illustrations in the drawings.

Figure 3:
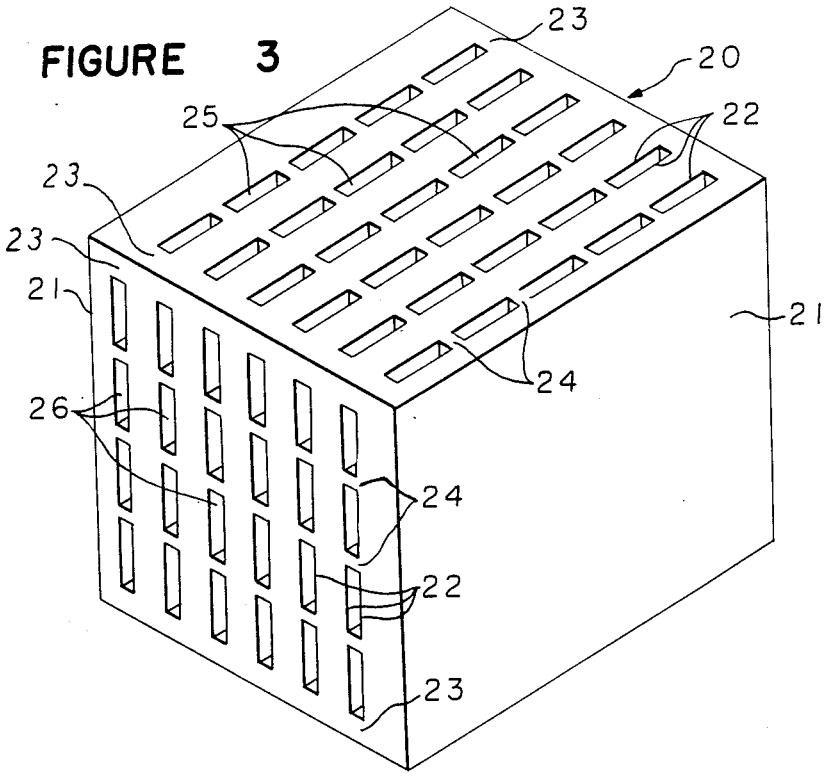
FIG. 3 is a perspective view of an embodiment of the filter unit according to the present invention.
Figure 4:
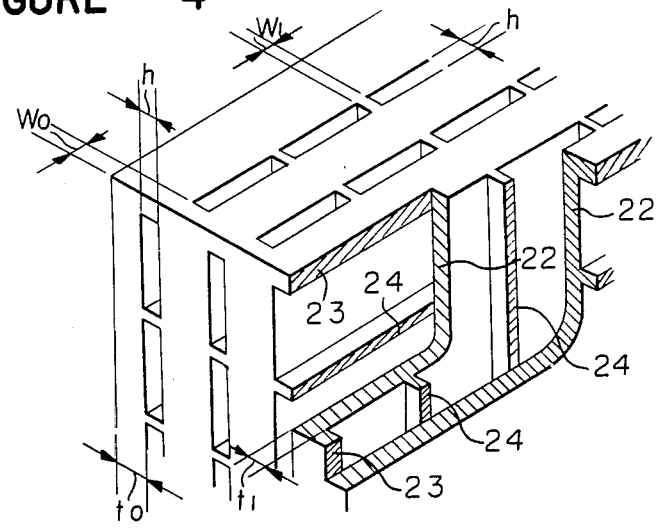
FIG. 4 is a perspective view partly broken of the filter unit shown in FIG. 3.

A filter unit which is typically used for an apparatus of the present invention is shown in FIGS. 3 and 4.

The filter unit 20 comprises plate-like bodies 21, 22 each having the same rectangular shape, ribs 23 and spacers 24. The plate-like bodies 21 constitute two opposing end faces of the filter unit 20 in a rectangular solid form. A plurality of plate-like bodies 22 are positioned in parallel to the plate-like bodies 21 at equal distances. Between adjacent pairs of plate-like bodies 21, 22, the ribs 23 are placed at opposing edge parts of the plate-like bodies 21, 22 and an appropriate number of the spacers 24 are placed between the ribs 23 so that they are in parallel to the both edges of the plate-like bodies. The direction of extension of the ribs 23 and the spacers 24 which are on one surface of each of the plate-like bodies 22 is perpendicular to the direction of extension of the ribs 23 and the spacers 24 which are on the other surface of the plate-like bodies 22, whereby particulate-containing gas passages 25 and clean gas passages 26, which are defined by the plate-like bodies and the ribs and respectively have both opened ends, are formed. The particulate-containing gas passages 25 and the clean gas passages 26 are alternately formed at each side of the plate-like bodies 22 as boundaries so that the particulate-containing gas passages 25 are opened in two opposing faces among the six outer faces of the filter unit 20 in the rectangular solid form, and the clean gas passages 26 are opened another two opposing faces of the filter unit 20. The clean gas passages 26 may be opened at one face of the two opposing faces of the filter unit 20 having the rectangular solid form and may be closed at the other face. It is preferable that the plate-like bodies 21, 22, the ribs 23 and the spacers 24 are made of the same air-permeable, porous material to make production of this filter unit easy. Of these elements, it is essential that the plate-like bodies 22 have filtering function as air-permeable, porous solid bodies. However, the plate-like bodies 21 and the ribs 23 may not be of such material but are sometimes preferable to fabricate them by using air-impermeable material depending on conditions of use. To render the plate-like bodies 21, the ribs 23 and the spacers 24 to have air-impermeable characteristic, they may be made by a dense material or they may be formed by an air-permeable, porous solid material and then, the outer surfaces of the solid material are applied with a coating agent to form an air-impermeable coating layer.

In the filter unit 20, the ribs 23 are required to form the particulate-containing gas passages 25 and the clean gas passages 26. The spacers 24 support the plate-like bodies 22 so as not to cause breakage of the plate-like bodies, which are thin in many cases, by gas pressure acting on the surfaces of the thin plate-like bodies 22. Accordingly, the spacers 24 may be omitted depending on conditions of use.

Ceramics is preferably used for the filter unit 20, especially for the air-permeable, porous solid material constituting the plate-like bodies 22. However, sintered powder-metal may be used. In the present invention, the filter unit 20 is sufficient to withstand a temperature of an exhaust gas from the diesel engine. Since the exhaust gas may be cooled before introduction to the filter unit 20, an organic material such as filter papar or filter cloth may be used for the filter unit 20 depending on conditions of use.

The thickness and the porosity of the air-permeable, porous solid material constituting the plate-like bodies 22 are selected in consideration of required particulate trapping efficiency, strength, pressure loss and so on.

As a typical method of manufacturing the filter unit 20, cores made of organic polymer are placed in a mold at positions to define the dust-containing passages 25 and the clear gas passages 26; a material such as ceramics slurry is poured in the mold to form a shaped ceramic product; then, the shaped ceramic product is immersed in a solvent to dissolve the cores, and thereafter, the shaped ceramic product is baked.

Figure 5:
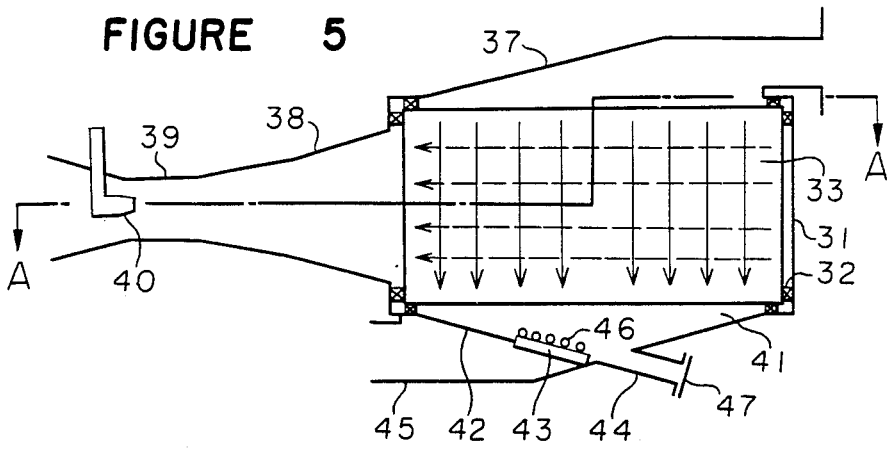
FIG. 5 is a longitudinal cross-sectional view of a first embodiment of the apparatus of the present invention.
Figure 6:
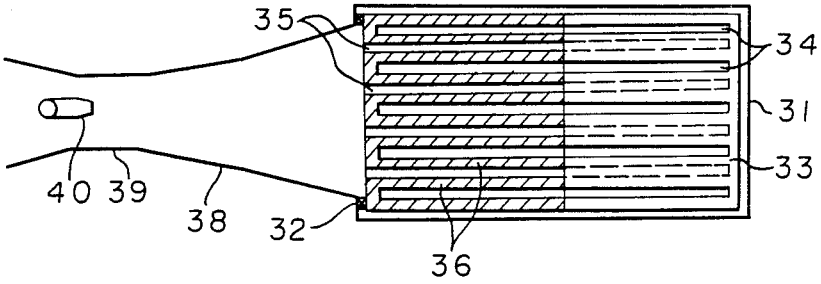
FIG. 6 is a transverse cross-sectional view taken along the line A—A in FIG. 5.

FIGS. 5 and 6 show the first embodiment of the apparatus according to the present invention.

A filter unit 33 having a rectangular solid form is installed in a casing 31 having openings at upper and lower parts and a side port by interposing sealing members 32. The filter unit 33 is substantially the same as the filter unit 20 as mentioned before. Namely, plate-like bodies 36 made of the air-permeable, porous material define particulate-containing gas passages 34 which vertically pass through the filter unit 33 (as shown by solid arrow marks in FIG. 5) and clean gas passages 35 (as shown by dotted arrow mark in FIG. 5) which respectively have one end closed and the other end opened.

An inlet duct 37 are formed at the upper part of the casing 31 to introduce the exhaust gas from the diesel engine. An outlet conduit 38 are connected to the casing 31 at a side where the clean gas passages 35 are opened. The outlet conduit 38 is provided with a throat portion 39 having a reduced diameter part, and the portions contiguous to the upstream and the downstream of the throat portion are gently expanded. A nozzle 40 for injecting a pressurized gas is provided near the throat portion 39 at the downstream side so as to open toward the upstream side.

A particulate receiving port 41 is provided at the lower part of the casing 31. The particulate receiving port 41 is provided with a tray 42, a filter plate 43 with an electric resistance type heater 46, an ash component removing port 44 with a cover plate 47 which is opened or closed (it is usually closed), and a gas duct 45.

A part of the bottom of the tray 42 is perforated and the filter plate 43 is fitted to that part so that the tray 42 and the filter plate 43 surround as a whole the lower open end of each of the particulate-containing gas passages 34. The ash component removing port 44 opens at the bottom of the tray 42, and the gas duct 45 is placed at the outside of the filter plate 43. The filter plate 43 is made of an air-permeable, porous material. The resistance to the permeability of the filter plate 43 is such that about 20% or lower portion, especially about 0.5%–5% portion of the exhaust gas introduced through the inlet duct 37 passes through the filter plate 43, and the remaining portion of the exhaust gas passes through the plate-like bodies 36 of the filter unit 33 to be flown to the outlet conduit 38.

The operation of the apparatus according to the first embodiment of the present invention will be described. The exhaust gas from the diesel engine is introduced from the inlet duct 37 via the upper open ends into the particulate-containing gas passages 34 of the filter unit 33. The most part of the exhaust gas passes through the plate-like bodies 36 and is flown to the outlet conduit 38 through the clean gas passages 35. However, particulates, particularly, carbon particulates in the exhaust gas can not pass through the plate-like bodies 36 and deposit on the inner surfaces of the particulate-containing gas passages 34. In some case, a part of the particulates is flown to the particulate receiving port 41 through the lower open end of the particulate-containing gas passages 34. A part of the exhaust gas is also flown to the particulate receiving port 41 and passes through the filter plate 43 to the gas duct 45. However, the particulates in the exhaust gas can not pass through the filter plate 43 and deposit on the inner surface of the filter plate 43.

After continuation of the particulate collecting operation as above-mentioned for an appropriate time, a short time back washing operation is carried out. In the back washing operation, a pressurized gas, especially pressurized air is ejected from the nozzle 40 for a short time such as about 0.1 sec–1 sec. The ejected gas induces the gas around the nozzle 40, and the gas of several times as much as the original pressurized gas is flown in a pulse form to the clean gas passages 35. The pulse gas flow is flown to the particulate-containing gas passages 34 through the plate-like bodies 36. Then, the particulates accumulated on the inner surfaces of the particulate-containing gas passages 34 are peeled off. A part of the particulates drifts in the particulate-containing gas passages 34, however, the most part drops into the particulate receiving port 41. In the particulate receiving port 41, a stream of gas is produced to pass through the filter plate 43, and with the gas flow, the most part of particulates deposit and accumulate on the inner surface of the filter plate 43.

Thus, the particulates trapped on the inner surfaces of the particulate-containing gas passages 34 during the particulate collecting operation are moved onto the inner surface of the filter plate 43 by carrying out the back washing operation to thereby refresh the filtering function of the filter unit 33. The particulates on the filter plate 43 are burned and removed by actuating the electric resistance type heater 46.

During a relatively long term use of the apparatus, there occurs accumulation of non-combustible particles and ash. In this case, the cover plate 47 is opened to drop the particles and ash. Alternatively, they may be forcibly recovered by a suitable scraping means.

Figure 7:
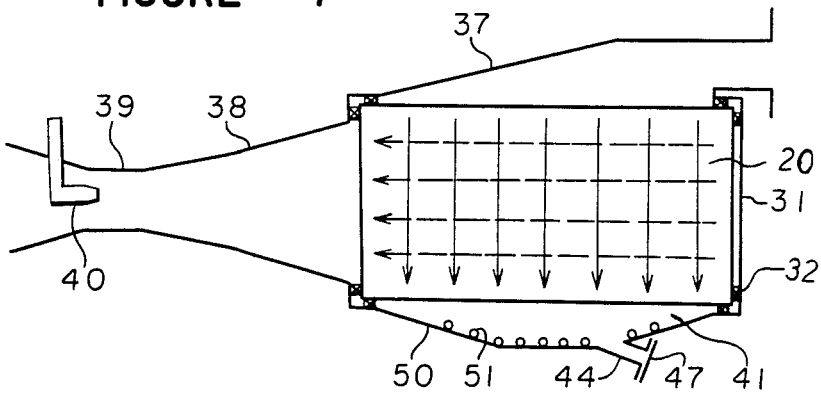
FIG. 7 is a longitudinal cross-sectional view of a second embodiment of the apparatus of the present invention.

FIG. 7 shows the second embodiment of the present invention. The second embodiment is substantially the same as the first embodiment except that the filter plate 43 and the gas duct 45 are not provided but a tray 50 made of an air-impermeable material is used to surround the lower part of the filter unit 20, and a heater 51 is provided on the substantially entire inner surface of the tray 50. Accordingly, the same reference numerals designate the same or corresponding parts and description of these parts is omitted.

In this embodiment, during the particulate collecting operation, the entire quantity of the exhaust gas introduced is flown to the outlet conduit 38. The most part of the particulates deposits and accumulates on the inner surfaces of the particulate-containing gas passages 34 although a part of the particulates falls on the tray 50. Of the particulates peeled off and fallen from the inner surfaces of the particulate-containing gas passages 34 by the back washing operation, an amount of the particulates drifting in the particulate-containing gas passages 34 and reversely flown to the inlet duct 37 is fairly large in comparison with the case in the first embodiment. However, since there occurs agglomeration of the particulates when they deposit on the inner surfaces of the particulate-containing gas passages 34, the particle size of the deposited particulates tend to become large. Accordingly, even in the case of the second embodiment, the most part of the particulates falls and accumulates on the tray 50, and substantially all particulates accumulate on the tray 50 during repetition of the particulate collecting/back washing operations. In the first embodiment using the filter plate 43, the almost entire quantity of the particulates is concentrated on the filter plate 43. However, in the second embodiment, the concentrating effect as above-mentioned can not be obtained and the particulates accumulate on the entire surface of the tray 50. This is the reason why the heater 51 is provided on the substantially entire surface of the tray 50. However, the heater 51 may be provided only at the bottom portion of the tray 50 in the case that the particulates slide along the slope of the tray 50. Alternatively, the heater 51 may be provided at only a limited area on the tray 50 so that the burning of the combustible particulates started from that area gradually expands in the other areas.

Figure 8:
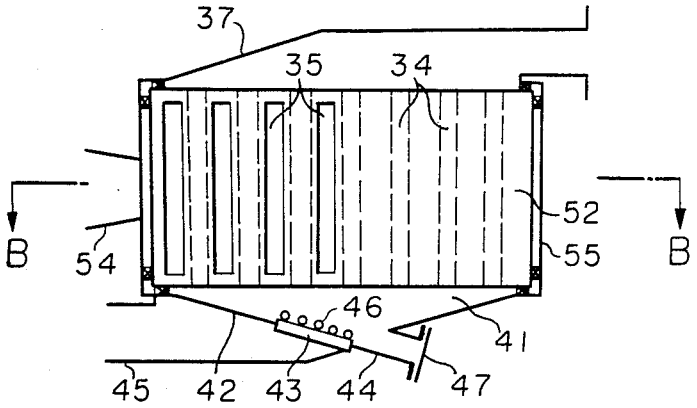
FIG. 8 is a longitudinal cross-sectional view of a third embodiment of the apparatus of the present invention.
Figure 9:
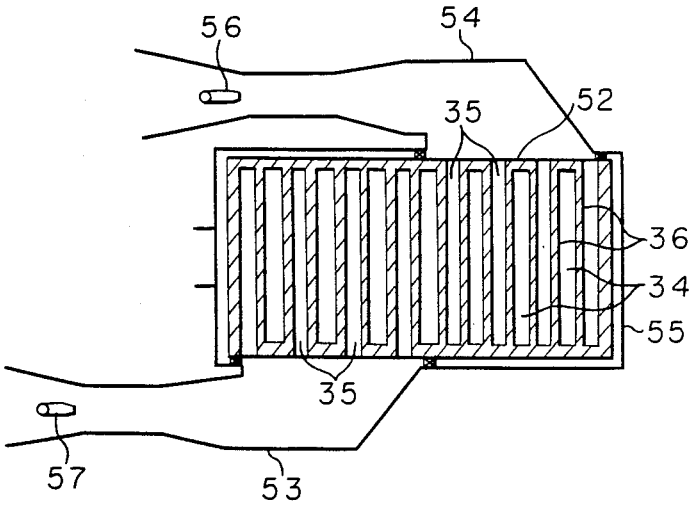
FIG. 9 is a transverse cross-sectional view taken along the line B—B in FIG. 8.

FIGS. 8 and 9 show the third embodiment of the present invention. In this embodiment, clean gas passages 35 of a filter unit 52 is divided into two groups, and each group is provided with an outlet conduit 53 or 54. The filter unit 52 is the same as the filter unit 33 of the first embodiment except that a face where each end of the clean gas passages 35 is open and a face where each other end of the passages 35 is closed are opposite between the two groups as described above. The first outlet conduit 53 containing a nozzle 57 is connected to one part of the casing 55 where the clean gas passages 35 belonging to one group open and the second outlet conduit 54 containing a nozzle 56 is connected to the other part of the casing 55 where the clean gas passages 35 belonging to the other group open.

The particulate collecting operation in the third embodiment is the same as that of the first embodiment except that the most part of the exhaust gas passed through the plate-like bodies 36 is fed into the two outlet conduits 53, 54. In the back washing operation, a pressurized gas is ejected alternately from the nozzles 56, 57 to thereby alternately refresh each half section of the filter unit 52. In the first embodiment, it is necessary that time for the back washing is short because the flow of the exhaust gas from the engine is blocked when the back washing operation is carried out. In this case, the pressure of the exhaust gas from the engine may increase even though the back washing operation is carried out for a short time, whereby the performance of the engine may be adversely affected. On the other hand, in the third embodiments, the half section of the filter unit 52 is active at the back washing time, and the time can be extensively prolonged. Accordingly, an adverse affection to the performance of the engine can be negligible. The prolonged back washing time provides such advantages that gas pressure for injection can be reduced; a gas-flow producing system for back washing other than use of the injection nozzle can be utilized, or the filter unit 52 can be effectively refreshed.

Figure 10:
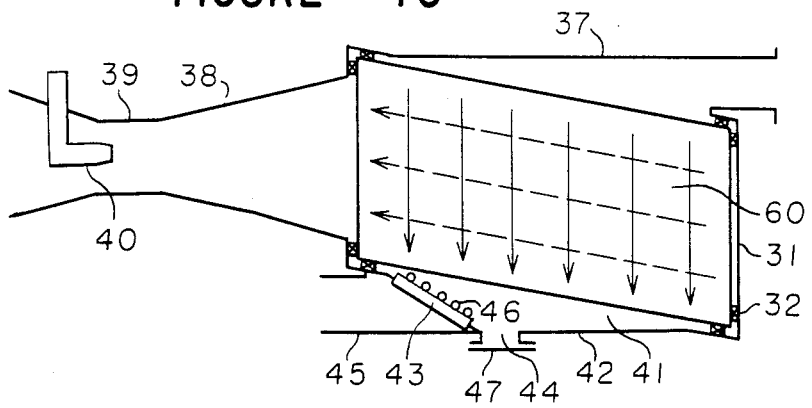
FIG. 10 is a longitudinal cross-sectional view of a fourth embodiment of the apparatus of the present invention.
Figure 11:
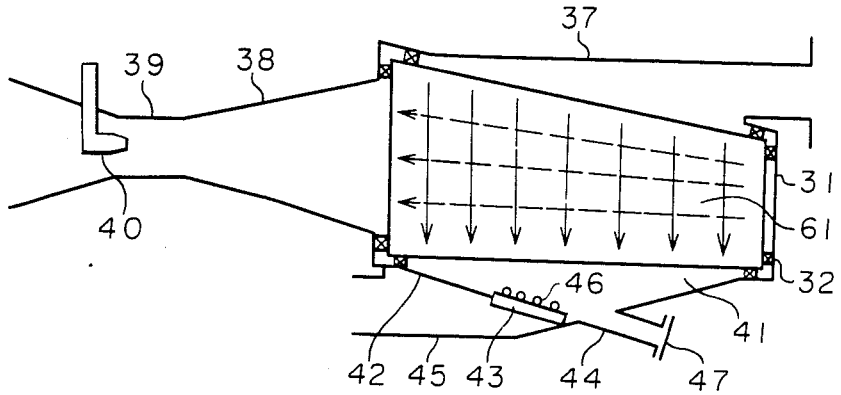
FIG. 11 is a longitudinal cross-sectional view of a fifth embodiment of the apparatus of the present invention.
Figure 12:
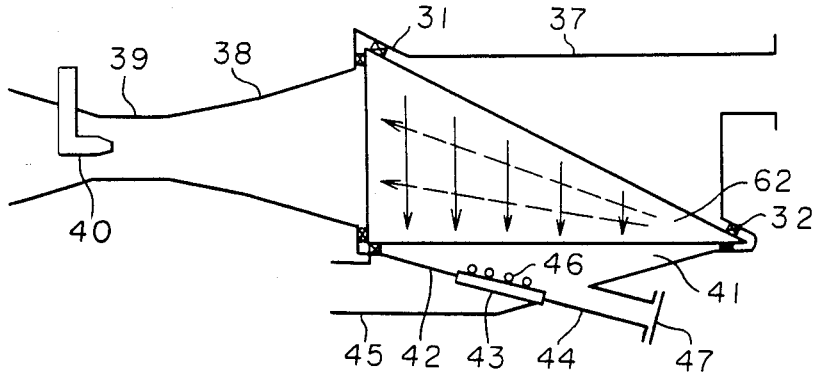
FIG. 12 is a longitudinal cross-sectional view of a sixth embodiment of the apparatus of the present invention.

FIGS. 10, 11 and 12 respectively show fourth, fifth and sixth embodiments. In these embodiments, a filter unit having a shape other than a rectangular solid form is used.

In the fourth embodiment, a tetragonal-prism-shaped filter unit 60 having a parallelogram with non-right-angled corners in cross-section is used. In the filter unit 60, the particulate-containing gas passages run in the vertical direction and the clean gas passages run along the slant side.

In the fifth embodiment, a tetragonal-prism-shaped filter unit 61 in which the cross-section indicates a trapezoid with parallel sides of different length is used. In the filter unit 61, the particulate-containing gas passages run in the vertical direction and the clean gas passages run in the direction as shown by dotted arrow marks in FIG. 11.

Figure 13:
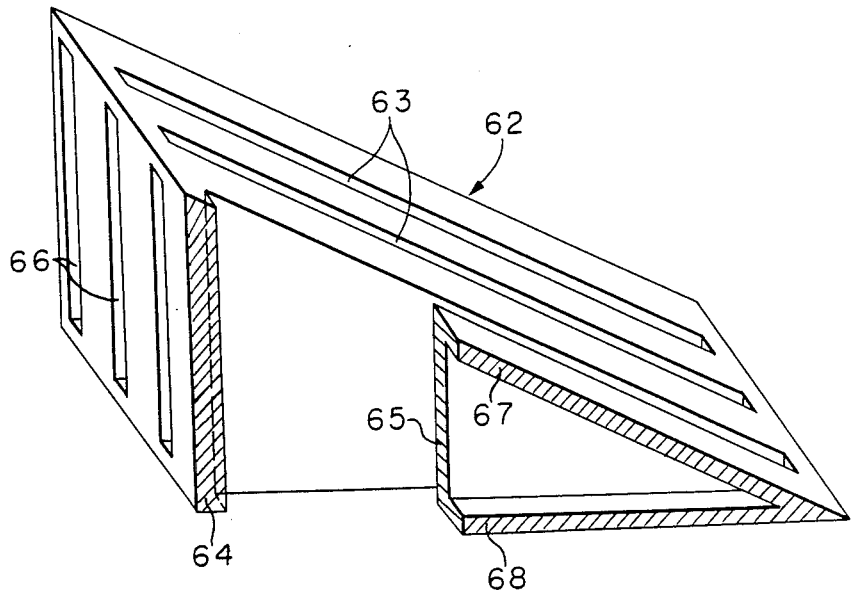
FIG. 13 is a perspective view partly broken of an important part of the filter unit used for the sixth embodiment.

In the sixth embodiment, a triangular-prism-shaped filter unit 62 as shown in FIG. 13 is used. As is understandable from FIG. 13, the particulate-containing gas passages 63 which open at the slant face and the bottom face are defined by ribs 64 extending along the side face and plate-like bodies 65, while clean gas passages 66 which open at the side face are defined by ribs 67 extending along the slant face, ribs 68 extending along the bottom face and the plate-like bodies 65.

As described above, the filter unit having a shape different from a rectangular solid form is used in the fourth to sixth embodiments. As is clear in comparison of the first embodiment with the fourth embodiment, the height of the apparatus including the inlet duct 37 and the particulate receiving port 41 can be reduced by utilizing the fourth embodiment although the filter unit 33 has the same volume and longitudinal cross-sectional area as the filter unit 60, i.e. the surface area for filtration of the filter unit 33 is the same as that of the filter unit 60. The feature of the fourth to sixth embodiments is advantageous when the apparatus according to the embodiments is to be fitted to the diesel engine for a vehicle in which the height of the floor of the vehicle is limited.

Figure 14:
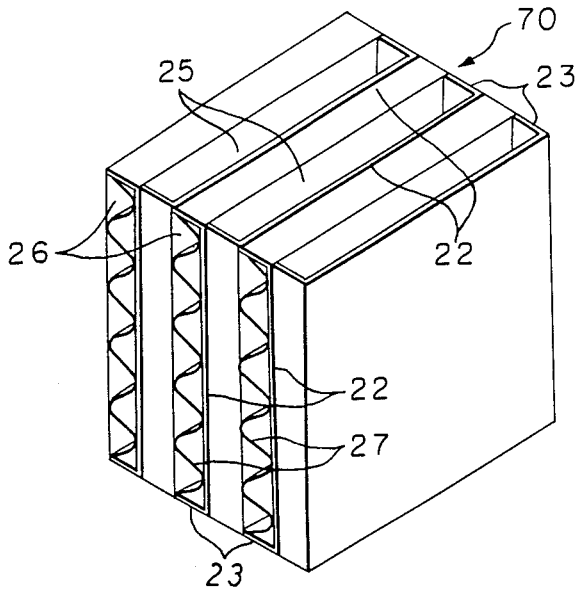
FIG. 14 is a perspective view of a still another embodiment of the filter unit used for the present invention.
Figure 15:
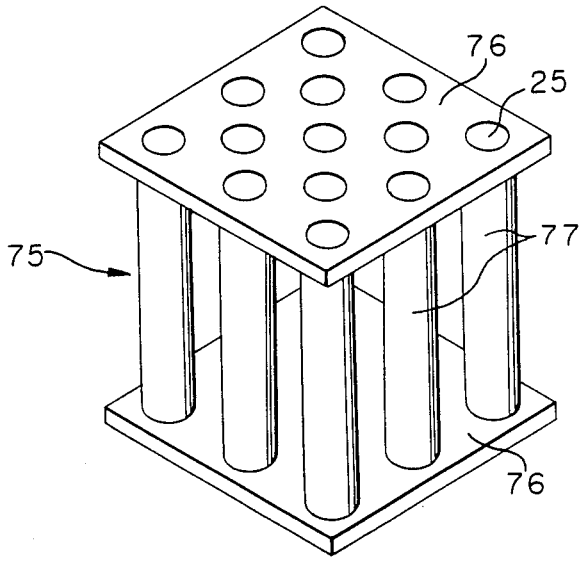
FIG. 15 is a perspective view of a still another embodiment of the filter unit used for the present invention.

FIGS. 14 and 15 respectively show other embodiments of the filter unit used in the present invention.

A filter unit 70 as shown in FIG. 14 is substantially the same as the filter unit 20 shown in FIG. 3 provided that the spacers 24 for defining the clean gas passages 26 are replaced by corrugated plates 27 in which the bottom portions and the ridge portions of the corrugated plates 27 are respectively in contact with the plate-like bodies 22.

A filter unit 75 as shown in FIG. 15 is provided with upper and lower perforated tube support plates 76, and a plurality of hollow tubes 77 are vertically placed between the upper and lower tube support plates 76 in parallel to and apart from each other. The tube support plates 76 and the hollow tubes 77 are connected so that the particulates can not pass through. The hollow tubes 77 are made of air-permeable, porous solid material to give filtering function. The inside of the hollow tubes 77 functions as particulate-containing gas passages 25 and a space outside the tubes 77 functions as clean gas passages.

With respect to the air-permeable, porous solid material constituting the filter unit 20, especially, the plate-like bodies 22, the statement was made as to use of the ceramics and the sintered powder-metal as preferable materials, and organic elements such as filter paper, filter cloth and so on as possibly usable materials. These materials are applicable to the filter of the present invention other than the filter unit 20.

Although it is desirable that the ribs to be provided along the edge portions of the plate-like bodies are along the outermost edge portions of the bodies, this invention includes such embodiment that the ribs are provided at slightly inner side from the outermost edge portions of the plate-like bodies as far as the surface area for filtration are not largely reduced.

The spacers to be provided at the central portion of the plate-like bodies may be partially or entired omitted. Further, it is not always necessary that the spacers are in parallel to the ribs provided along the edge portions even though the spacers are needed.

It is preferable that the outermost plate-like bodies in a filter unit, which correspond to the plate-like bodies 21 for the filter unit 20, are air-impermeable, whereby leakage of the exhaust gas toward the outside of the filter unit is prevented. The outermost plate-like bodies can not be refreshed by the back washing operation. When the plate-like bodies is of the air-permeable material, the particulates deposited and accumulated on their inner surfaces can not be removed; however, when these are air-impermeable, the above-mentioned problem can be avoided.

The filter unit preferably has the surface area of partition walls (for instance, the plate-like bodies 22 or the hollow tubes 77) having filtering function per unit volume based on the outer dimension of the filter unit is 0.2 $cm^2/cm^3$ or greater, preferably, 0.5 $cm^2/cm^3$ or greater in order to form a compact filter unit.

It is preferable that the surface area of the particulate receiving port is 20% or lower, preferably 10% or lower with respect to the surface area of the partition walls having filtering function of the filter unit. As a result, a re-collection rate for the particulates per unit surface area of the particulate receiving port becomes great in the case that the particulates are re-collected on the particulate receiving port by the back washing operation, and the post-treatment such as burning of the collected particulates or discharge of the particulates out of the system by using a suitable means can be easy. Especially, the capacity of a burning means can be small. For instance, when the burning means placed in the particulate receiving port is an electric resistance type heater, a power consumption can be small; when a fuel-feeding type burner is used, a fuel consumption rate can be reduced, and when an oxidation catalyst is used, a quantity of the catalyst can be saved. In these cases, once combustion of the particulates is initiated at an appropriate part, a desired effect that the combustion automatically expands to the substantially entire area of the particulate receiving port is expected.

A single or plural particulate receiving ports may be used. In either case, it is preferable that the whole area of openings of the particulate-containing gas passages at the side of the particulate receiving port is surrounded or closed by the single or the plural particulate receiving ports. If a part of the area of the particulate-containing gas passages at the particulate receiving port side is not surrounded or closed by the port, efficiency of collecting the particulates decreases. Use of a plural number of the particulate receiving ports gives such advantage that even though difference in a particulate collection rate takes place at different locations of the filter unit due to the shape and the position of the filter unit, the structure of the particulate receiving ports can be designed as desired so as to compensate such difference of the particulate collection rate.

The particulate receiving port is generally formed separated from the filter unit. The separated particulate receiving port causes an easy selection of material for the filter unit and the particulate receiving member, and easy maintenance and replacement of the constituting elements. However, the particulate receiving port may be in one-piece structure with the filter unit.

As to a back washing means, a pressurized gas ejection nozzle provided in the outlet conduit is preferably used from the viewpoint of making an apparatus of the present invention compact and its high back-washing ability although it is not limited to the above-mentioned embodiment.

The particulates which are re-collected on the particulate receiving port is preferably removed by burning them although a way of mechanically removing the particulates such as scraping them at an appropriate time of interval may be utilized. As examples of desirable burning means, there are an electric resistance type heater, an oxidation catalyst, a fuel feeding type burner and so on. Such burning means may be provided only at the bottom portion of the particulate receiving port. It is desirable that the burning means is used to heat the air-permeable, porous solid body when a part of the particulate receiving port is constituted by such body.

It is preferable that the particulate-containing gas passages have their openings at the upper and lower parts of the filter unit and the inlet duct is connected to the upper part of the filter unit because a naturally falling phenomenon of the particulates can be utilized. On the other hand, the filter unit may be so placed that the particulate-containing gas passages extend laterally because the particle size and the weight of the particulates are small even though there causes agglomeration. The present invention further contains an embodiment in which the particulate-containing gas passages extend vertically and the inlet duct is connected to the lower part of the filter unit.

In accordance with the present invention, the filter unit can be refreshed by removing the particulates deposited and accumulated on the partition walls without heating the filter unit up to a high temperature. Accordingly, the filter unit having thin wall portions which might be easily molten and damaged by heat can be utilized. Flexibility concerning selection of material for the filter unit can be extensively widened. The function of filtration of the filter unit can be stably maintained for a long term since the filter unit is not heated at a high temperature. A structure to burn the particulates on the particulate receiving port is greatly simplified in comparison with a structure to burn them on the filter unit.

In the present invention, the filter plate provided in the particulate receiving port may be heated at a high temperature in comparison that the filter unit is heated at a high temperature in the conventional technique. It is understandable that it is far easy to manufacture a filter plate having small and simplified form so as not to cause damage by melting in comparison with a large-sized, complicated, thin-walled filter unit being fabricated so as not to cause melting. Further, it is understandable that replacement of the filter plate (even if it be damaged by melting) is more economical than replacement of the filter unit.

In the conventional technique, the burning means is provided only at an end part of the filter unit so that the combustion of the particulates initiated at the end part expands to the central portion of the filter unit to thereby remove the particulates in the whole filter unit. In order to expand the combustion to the whole filter unit, it is necessary that an amount of the particulates deposited per surface area for filtration reaches a certain value or higher. In the conventional technique, therefore, a regeneration cycle during the continuous operation required about one hour, and average pressure loss was high during the particulate-collecting operation. On the other hand, in the present invention, there are no such restrictions, and the regeneration cycle can be employed within a desired time, whereby average pressure loss during the particulate-collecting operation can be reduced.

Further, in the present invention, accumulation of non-combustible components on the filter unit can be prevented.

[EXPERIMENTAL EXAMPLE]

A particulate treating apparatus as shown in FIG. 7 was assembled by using the filter unit 20 shown in FIGS. 3 and 4.

As material for a filter unit 20, a porous cordierite sintered ceramics having the total porosity of about 37%, an open porosity of about 22%, an average pore size of about 20 μm and a bulk density of about 1.65 g/cm$^3$ was used. By using plate-like bodies 21 having a thickness $t_0$ of 12 mm, plate-like bodies 22 having a thickness $t_1$ of 3 mm and by determining the width of a slit h to be 3 mm, each 20 layers of particulate-containing gas passages 25 and clean gas passages 26 were alternately formed. Three pieces of spacers 24 having a thickness $w_1$ of 3 mm were respectively placed at an equivalent distance in each of the dust-containing passages 25 and the clean gas passages 26 which were respectively defined by slits having a length of 230 mm, wherein at the both ends of the slits, ribs 23 having a thickness $w_0$ of 15 mm were placed. Thus, the filter unit constitutes a cubic body having a side of about 260 mm and having the surface area of filtration of about 2.2 m$^2$. An exhaust pipe of a diesel engine having 160 HP was connected to an inlet duct 37. The temperature of an exhaust gas from the engine was about 310° C., the flow rate of the exhaust gas was about 1,200 m$^3$/hr, and the content of particulates in the exhaust gas was 220–280 mg/Nm$^3$.

The filter unit 20 is so placed that the particulate-containing gas passages 25 open at the upper and lower faces, and one of the two side faces of the filter unit where the clean gas passages 26 open is closed by a casing 31 and an outlet conduit 38 was connected to the other side face.

A tray 50 formed of a metallic body having an inner surface area of about 820 $cm^2$ was placed at the lower face where the particulate-containing gas passages 25 open. The tray 50 had the inner surface coated with an heat insulation material. A 200 W electric resistance type heater 51 was placed at the central portion having a surface area of about 500 $cm^2$.

The exhaust gas from the diesel engine was continuously fed for 20 hours from the inlet duct 37 into the filter unit 20. For each 10 minute particulate collecting operation, a back washing operation was carried out by ejecting air of about 5 $kg/cm^2$ for about 0.2 second through a nozzle 40.

A value of pressure loss in the filter unit 20 was obtained by measuring difference in pressure between gas pressure in the inlet duct 37 and the atmospheric pressure. The pressure loss in the virgin filter unit 20 under the same condition was about 450 mm $H_2O$. The pressure loss about 3 minutes after the back washing increased to about 850–900 mm $H_2O$ after the continuous operation of 2 hours. Thereafter, increase in the pressure loss is very small. The pressure loss about 10 hours after the initiation of the operation was about 900–1,000 mm $H_2O$ and thereafter it was substantially constant. It was recognized that difference in pressure loss between just before the back washing operation and just after the operation was 200–300 mm $H_2O$. This shows that regeneration of the filter unit 20 by the back washing operations was smoothly carried out. During a 20 hour continuous operation, a measurable amount of particulates was not detected in the exhaust gas from the outlet conduit 38, and accordingly, it was estimated that an amount of particulates passed through the filter unit 20 was 0–20 $mg/Nm^3$.

A considerable amount of particulates was accumulated on the tray 50 when the heater 51 was not actuated. When the heater 51 was actuated, the combustion of the particulates was initiated after the temperature of the heater 51 reached about 500° C. When the temperature of the heater 51 reached about 600° C., the substantially entire amount of the particulates on the tray 50 was burnt in a short time, and there was found non-combustible components of about 3 wt. % to the total weight of the particulates.

What is claimed:

1. An apparatus for treating particulates in an exhaust gas from a diesel engine which comprises:

a filter unit provided with partition walls made of an air-permeable, porous solid material which define a plurality of particulate-containing gas passages having opened ends and at least one clean gas passage separated from said particulate-containing gas passages by said partition walls, an inlet duct for distributing and feeding said exhaust gas from the diesel engine to one side of said opened ends of the particulate-containing gas passages, a particulate receiving port which surrounds the other side of said opened ends of the particulate-containing gas passages, an outlet conduit for the exhaust gas which flows from said particulate-containing gas passages through said partition walls to said clean gas passage, a back washing means for generating intermittently a flow of gas which flows from said clean gas passage through said partition walls to said particulate-containing gas passages, and a burning means for burning and removing combustible particulates collected in said particulate receiving port.

2. The apparatus according to claim 1, wherein said partition walls are made of one from the group consisting of ceramics and sintered powder-metal.

3. The apparatus according to claim 1, wherein said filter unit comprises a plurality of tubes made of an air-permeable, porous solid material which are arranged in parallel to and separated from each other and two tube support plates for supporting both ends of the tubes.

4. The apparatus according to claim 1, wherein said filter unit comprises a plurality of plate-like bodies having the same shape and made of an air-permeable, porous material, said plate-like bodies being arranged in parallel to and apart from each other, and a plurality of ribs provided between each adjacent pairs of said plate-like bodies at their edge portions so as to form one of particulate-containing gas passages and clean gas passages, wherein on one side of each of said plate-like bodies which are adjacent to each other, there are no ribs at the positions facing said inlet duct and said particulate receiving port, while on the other side of each of said plate-like bodies, there are no ribs at the positions facing said outlet conduit.

5. The apparatus according to claim 4, wherein said plate-like bodies are respectively tetragonal.

6. The apparatus according to claim 5, wherein said plate-like bodies are square.

7. The apparatus according to claim 5, wherein said plate-like bodies are in a parallelogram form with non-right-angled corners.

8. The apparatus according to claim 5, wherein said clean gas passages are opened at only one side of the tetragonal plate-like bodies.

9. The apparatus according to claim 5, wherein said clean gas passages are opened at opposing sides of the tetragonal plate-like bodies.

10. The apparatus according to claim 4, wherein said plate-like bodies are triangular.

11. The apparatus according to claim 4, wherein said ribs are made of substantially the same material as the plate-like bodies.

12. The apparatus according to claim 4, wherein a spacer is placed between each adjacent pairs of said plate-like bodies to support and fix the portions other than their edge portions of the plate-like bodies.

13. The apparatus according to claim 4, wherein the outermost plate-like bodies among said plate-like bodies are made of an air-impermeable material.

14. The apparatus according to claim 1, wherein said particulate-containing gas passages are opened at the upper and lower parts of said filter unit, and said inlet duct is connected to the upper opening part of the particulate-containing gas passages.

15. The apparatus according to claim 1, wherein at least a part of said particulate receiving port is made of an air-permeable, porous material.

16. The apparatus according to claim 1, wherein the surface area of said particulate receiving port is 20% or lower than the surface area of said partition walls having filtering function.

17. The apparatus according to claim 1, wherein said particulate receiving port is single in number, and the other opening part of said particulate-containing gas passages is entirely surrounded by said particulate receiving port.

18. The apparatus according to claim 1, wherein an ash component removing port is provided in said particulate receiving port.

19. The apparatus according to claim 1, wherein a plural number of said outlet conduits are provided at positions where said clean gas passage of the filter unit is opened.

20. The apparatus according to claim 1, wherein said back washing means is an injection nozzle placed in said outlet conduit to eject a pressurized gas.

21. The apparatus according to claim 1, wherein said burning means is one from the group consisting of an oxidation catalyst, an electric resistance type heater and a fuel-feeding type combustion burner provided in said particulate receiving port.

22. The apparatus according to claim 15, wherein said burning means is one from the group consisting of an oxidation catalyst, an electric resistance type heater and a fuel-feeding type combustion burner to heat said air-permeable porous solid material constituting said particulate receiving port.

23. The apparatus according to claim 1, the surface area of said partition walls having filtration function per unit volume of said filter unit based on its outer dimension is at least 0.2 $cm^2/cm^3$.

24. The apparatus according to claim 15, wherein the surface area of said air-permeable, porous solid material constituting said particulate receiving port is no greater than 10% of the surface area of said partition walls having filtering function.

25. An apparatus for treating particulates in an exhaust gas from a diesel engine which comprises:

a filter unit having a plurality of plate-like bodies made of an air-permeable, porous material and having the same shape, which are arranged in parallel to and separated from each other, and ribs provided between each adjacent pairs of said plate-like bodies at their edge portions so as to form one of particulate-containing gas passages and clean gas passages, wherein on one side of each of said plate-like bodies which are adjacent to each other, there are no ribs at the positions facing an inlet duct and a particulate receiving port, while on the other side of each of said plate-like bodies, there are no ribs at the position facing an outlet conduit, whereby a plurality of the particulate-containing gas passages having opened ends and a plurality of the clean gas passages are formed by said plate-like bodies which function as a boundary, said inlet duct distributing and feeding said exhaust gas from the diesel engine to one side of said opened ends of the particulate-containing gas passages, said particulate receiving port surrounding the other side of said opened ends of the particulate-containing gas passages, said outlet conduit for the exhaust gas which flows from said particulate-containing gas passages through said plate-like bodies to said clean gas passages, and a back washing means for generating intermittently a flow of gas which flows from said clean gas passages through said plate-like bodies to said particulate-containing gas passages.

26. The apparatus according to claim 25, wherein said particulate receiving port is provided as a separate body from said filter unit.

27. The apparatus according to claim 25, wherein said plate-like bodies are made of one from the group consisting of ceramics and sintered powder-metal.

28. The apparatus according to claim 25, wherein said plate-like bodies are tetragonal.

29. The apparatus according to claim 28, wherein said plate-like bodies are square.

30. The apparatus according to claim 28, wherein said clean gas passages are opened at only one side of said tetragonal plate-like bodies.

31. The apparatus according to claim 28, wherein said clean gas passages are opened at opposing sides of said tetragonal plate-like bodies.

32. The apparatus according to claim 25, wherein said ribs are made of substantially the same material as said plate-like bodies.

33. The apparatus according to claim 25, wherein the outermost plate-like bodies among said plate-like bodies are air-impermeable.

34. The apparatus according to claim 25, wherein said particulate-containing gas passages are opened at the upper and lower parts of said filter unit, and said inlet duct is connected to said upper opening part of the particulate-containing gas passages.

35. The apparatus according to claim 25, wherein at least a part of said particulate receiving port is made of an air-permeable, porous material.

36. The apparatus according to claim 25, wherein said particulate receiving port is single in number, and the other openings of said particulate-containing gas passages are entirely surrounded by said particulate receiving port.

37. The apparatus according to claim 26, wherein a removing port is formed in said particulate receiving port.

38. The apparatus according to claim 25, wherein a spacer is provided between each adjacent pairs of said plate-like bodies to support and fix the portion other than the edge portions of said plate-like bodies.

39. The apparatus according to claim 25, wherein a plurality of said outlet conduits are provided at positions where the clean gas passages of said filter unit open.

40. The apparatus according to claim 25, wherein said back washing means is an injection nozzle provided in said outlet conduit to eject a pressurized gas.

41. The apparatus according to claim 25, wherein the surface area of said plate-like bodies having filtering function per unit volume of said filter unit based on its outer dimension is at least 0.2 $cm^2/cm^3$.

42. The apparatus according to claim 35, wherein the surface area of said air-permeable, porous solid material constituting said particulate receiving port no greater than 10% of the surface area of said plate-like bodies of said filter unit having filtering function.

43. The apparatus according to claim 5, wherein said plate like bodies are in a trapezoid form having parallel sides of different length.

44. The apparatus according to claim 5, wherein said plate like bodies are rectangular.

45. The apparatus according to claim 28, wherein said plate like bodies are rectangular.

46. The apparatus according to claim 1, including plural particulate receiving ports, the other opening part of said particulate-containing gas passages being entirely surrounded by said particulate receiving ports.

47. The apparatus according to claim 25, including plural particulate receiving ports, the other openings of said particulate-containing gas passages being entirely surrounded by said particulate receiving ports.

48. The apparatus according to claim 35, wherein substantially the entire portion of said particulate receiving port is made of an air-permeable, porous material.

49. The apparatus acording to claim 15, wherein substantially the entire portion of said particulate receiving port is made of an air-permeable, porous material.

* * * * *